US012310435B2

(12) United States Patent
Lu

(10) Patent No.: US 12,310,435 B2
(45) Date of Patent: May 27, 2025

(54) MAGNETIC GLOVES

(71) Applicant: Shenzhen Jianlida Textile Co., Ltd., Shenzhen (CN)

(72) Inventor: Yusheng Lu, Shenzhen (CN)

(73) Assignee: Shenzhen Jianlida Textile Co., Ltd., Shenzhen (CN)

( * ) Notice: Subject to any disclaimer, the term of this patent is extended or adjusted under 35 U.S.C. 154(b) by 0 days.

(21) Appl. No.: 18/347,999

(22) Filed: Jul. 6, 2023

(65) Prior Publication Data

US 2025/0009053 A1 Jan. 9, 2025

(51) Int. Cl.
*A41D 19/015* (2006.01)
*A41D 19/00* (2006.01)

(52) U.S. Cl.
CPC ... *A41D 19/0006* (2013.01); *A41D 19/01523* (2013.01); *A41D 19/01547* (2013.01)

(58) Field of Classification Search
CPC ..... A41D 19/0157; A41D 19/0006; A41D 19/01523; A41D 19/01547; A41D 19/0024; A41D 19/0031; A41D 19/0051; A41D 27/085
USPC ..... 2/21, 163
See application file for complete search history.

(56) References Cited

U.S. PATENT DOCUMENTS 772,197 A * 10/1904 Weaver ..... A61F 13/00 2/21
4,045,824 A * 9/1977 Weppler ..... A41D 19/0013 2/163
6,401,253 B2 * 6/2002 Brunson ..... A41D 19/01594 224/183
6,592,235 B1 * 7/2003 Mayo ..... G08B 5/004 2/160
6,990,689 B1 * 1/2006 Thellmann ..... A63B 71/148 2/161.1

FOREIGN PATENT DOCUMENTS

CN 214594404 U 11/2021
CN 215013898 U 12/2021

* cited by examiner

*Primary Examiner* — Sally Haden
(74) *Attorney, Agent, or Firm* — Nitin Kaushik

(57) ABSTRACT

The invention discloses a magnetic glove, which comprises a body and a first magnetic adsorption component. The body comprises a main body part and multiple finger parts connected to the main body part, and the first magnetic adsorption component is arranged on the back side of the main body part. The invention sets the first magnetic adsorption component on the back side of the main body part, facilitating the use of magnetic adsorption to fix screws and other components. This does not affect the normal function of the gloves and allows the other hand to easily pick up the screws, avoiding the need to repeatedly grab screws from pockets or containers, especially in cramped spaces where this is difficult. Therefore, the use of gloves in this scheme greatly improves the convenience of using screws and is also beneficial for improving work efficiency.

8 Claims, 14 Drawing Sheets

MAGNETIC GLOVES

TECHNICAL FIELD

The invention relates to the field of household goods, in particular to a magnetic glove.

BACKGROUND

As a type of daily necessities, gloves are widely used in various fields to protect the human hands or prevent contamination of the items being handled. However, there can be a lack of sensitivity when handling small objects while wearing gloves. For example, when using screws and other components to complete the assembly process at high altitude, the screws are usually placed in the pockets or storage bags of clothes. It is extremely inconvenient to grab the screws while wearing gloves.

SUMMARY

The main purpose of the invention is to provide a type of magnetic glove to solve the technical problems proposed in the background technology.

To achieve the above purpose, the invention proposes a magnetic glove, which includes a body and a first magnetic adsorption component. The body includes a main body part and multiple finger parts connected to the main body part, and the first magnetic adsorption component is arranged on the back side of the main body part.

The magnetic gloves provided in the embodiment of the invention are arranged on the back side of the main body part, facilitating the use of magnetic adsorption to fix screws and other components. This does not affect the normal function of the gloves and allows the other hand to easily pick up the screws, avoiding the need to repeatedly grab screws from pockets or containers, especially in cramped spaces where this is difficult. Therefore, the use of gloves in this scheme greatly improves the convenience of using screws and is also beneficial for improving work efficiency.

EXPLANATION OF FIGURE MARKINGS

100. Body; 110. Main body part; 111. Shock-proof layer; 112. Tightening structure; 113. Storage part; 114. Outer protective layer; 115. Inner liner; 116. Reinforcing layer; 120. Finger part; 121. Anti-slip texture; 122. Elastic section; 130. Luminous finger part; 140. First section; 141. First adjustment hole; 142. Fourth Velcro; 150. Second section; 151. Second adjustment hole; 152. Fifth Velcro; 160. Tension rope; 161. Stretch section; 162. Fixing section; 170. Fixing member; 171. Third Velcro; 180. Flexible tape; 200. First magnetic adsorption component; 210. Magnetic disc; 220. Fixing part; 221. Second Velcro; 300. Power module; 310. Main control part; 311. Charging circuit; 312. Switch; 320. Battery; 400. Fill light; 500. Semiconductor chilling plate.

DETAILED DESCRIPTION OF THE EMBODIMENTS

The following will provide a clear and complete description of the technical solution in the embodiments of the invention in conjunction with the figures. Obviously, the described embodiments are only a part of the embodiments of the invention. Based on the embodiments of the invention, all other embodiments obtained by ordinary technicians in the field without creative labor are within the scope of protection of the invention.

In addition, the technical solutions among the various embodiments can be combined with each other, but it must be based on what can be achieved by the ordinary skilled man in the art. When the technical solutions contradict each other when they are combined, or they cannot be realized, it should be considered that the combination of this technical solution does not exist and is not within the scope of protection required by the invention.

Figure 1:
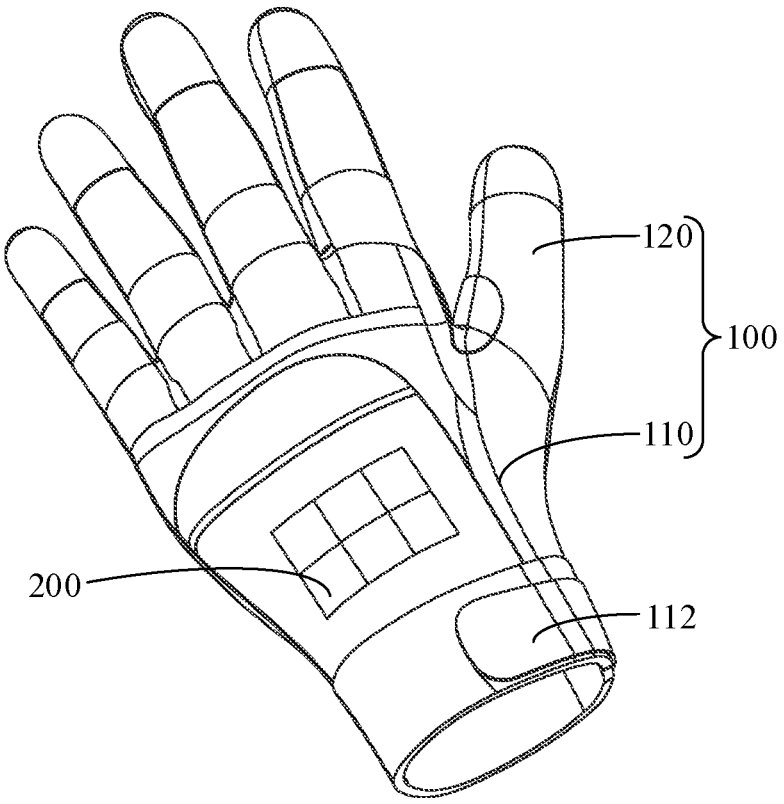
FIG. 1 is a structural schematic diagram of the first embodiment of the magnetic glove in the invention.

The invention proposes a magnetic glove, as shown in FIG. 1. The magnetic glove comprises a body 100 and a first magnetic adsorption component 200, wherein the body 100 comprises a main body part 110 and multiple finger parts 120 connected to the main body part 110. The first magnetic adsorption component 200 is arranged on the back side of the main body part 110.

Wherein, the body 100 can be designed according to the style of the existing gloves. For example, the number of finger part 120 is five, which are the thumb part, index finger part, middle finger part, ring finger part and small thumb part, to respectively cover the thumb, index finger, middle finger, ring finger and small thumb, and the main body part 110 is used to cover the palm of the hand. Mainly, the first magnetic adsorption component 200 is located on the back side of the main body part 110, i.e., the palm back side, to facilitate the use of magnetic adsorption to fix screws and other components. This does not affect the normal function of the gloves and allows the other hand to easily pick up the screws, avoiding the need to repeatedly grab screws from pockets or containers, especially in cramped spaces where this is difficult. Therefore, the use of gloves in this scheme greatly improves the convenience of using screws and is also beneficial for improving work efficiency.

Figure 2:
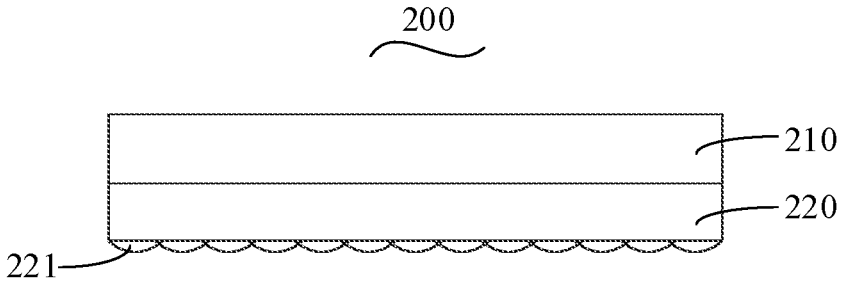
FIG. 2 is a structural schematic diagram of the first magnetic adsorption component in FIG. 2.

As shown in FIGS. 1 and 2, the first magnetic adsorption component 200 preferably includes a fixing part 220 and a magnetic disc 210 arranged on the fixing part 220, which is detachably connected to the main body part 110. Among them, the detachable connection method can be bonding, clamping, or screw connection to facilitate the replacement of the first magnetic adsorption component 200 when its magnetism weakens. In addition, the magnetic disc 210 is preferably made of hard magnetic material to avoid frequent replacement due to damage. Of course, a protective film can also be coated on the surface of the magnetic disc 210, which is more conducive to avoiding damage to the magnetic disc 210 during use.

As shown in FIG. 2, the main body part 110 is preferably provided with a first hook-and-loop component, the first hook-and-loop component is a first Velcro, and the fixing part 220 is provided with a second hook-and-loop component 221, the second hook-and-loop component is a second Velcro, and the first Velcro is bonded with the second Velcro 221. Among them, the first Velcro is preferably in the form of a burr, and the second Velcro 221 is in the form of a loop. Utilizing the characteristic of the burr having a long service life and being not easy to be damaged in repetitive disassembly and assembly, it is beneficial for the glove to repeatedly replace the first magnetic adsorption component 200 in long-term use. In addition, due to the different sizes of the palms, gloves will undergo certain deformation during the wearing process, and Velcro generally adopts the form of fabric tape, which have a certain deformation ability, thus also conducive to improving the adaptability of gloves.

As shown in FIG. 2, the main body part 110 is preferably provided with a first Velcro, and the fixing part 220 is provided with a second Velcro 221, and the first Velcro is bonded with the second Velcro 221. Among them, the first Velcro is preferably in the form of a burr, and the second Velcro 221 is in the form of a loop. Utilizing the characteristic of the burr having a long service life and being not easy to be damaged in repetitive disassembly and assembly, it is beneficial for the glove to repeatedly replace the first magnetic adsorption component 200 in long-term use. In addition, due to the different sizes of the palms, gloves will undergo certain deformation during the wearing process, and Velcro generally adopts the form of fabric tape, which have a certain deformation ability, thus also conducive to improving the adaptability of gloves.

Figure 3:
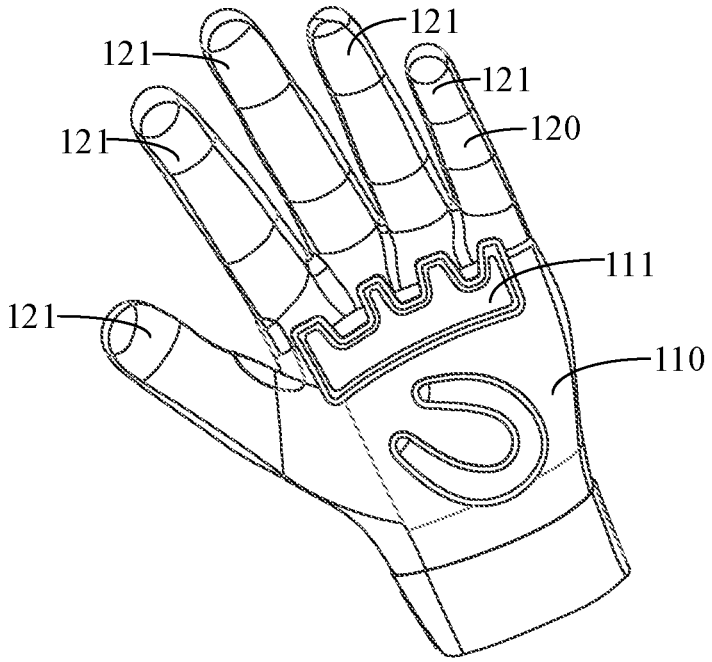
FIG. 3 is a structural schematic diagram of the magnetic gloves from another perspective in FIG. 1.

As shown in FIG. 3, the finger part 120 is preferably provided with the anti-slip texture 121. Among them, the anti-slip texture 121 can be only set at the fingertips of the finger part 120 to avoid slipping when grasping screws and other components, or the finger part 120 can be provided with anti-slip texture 121 to increase friction when grasping large objects.

As shown in FIG. 3, the front face of the main body part 110 is preferably provided with the shock-proof layer 111. Among them, the shock-proof layer 111 is mainly concentrated at the center of the front face of the main body part 110, which is the palm position, in order to reduce vibration damage to users. In addition, the shock-proof layer 111 can be made of sponge, silicone, and other foam materials, and is in a honeycomb shape to facilitate vibration absorption. Of course, the material of the shock-proof layer 111 can also be silicone, which is soft and can generate corresponding deformation according to the grip and opening of the hand. It is also heat-resistant and can effectively prevent hand burns. It should be noted that in this utility model, the anti-collision and shock-proof layer 111 is integrally formed. The use of an integrally formed structure not only makes the shock-proof layer 111 more tightly protect the fingers and backs of workers, but also simplifies the manufacturing process of the magnetic protective gloves provided by this utility model, reducing production costs. In this embodiment, by setting a shock-proof layer 111 at the center of the palm, the impact or knocking force applied to the palm is dispersed and absorbed, ensuring the safety of the palm and fingers of the worker.

Preferably, the body 100 is made of breathable material. Among them, the overall use of breathable materials in the body 100 is conducive to heat dissipation, especially suitable for use in high temperature conditions, improving the comfort of gloves.

Figure 4:
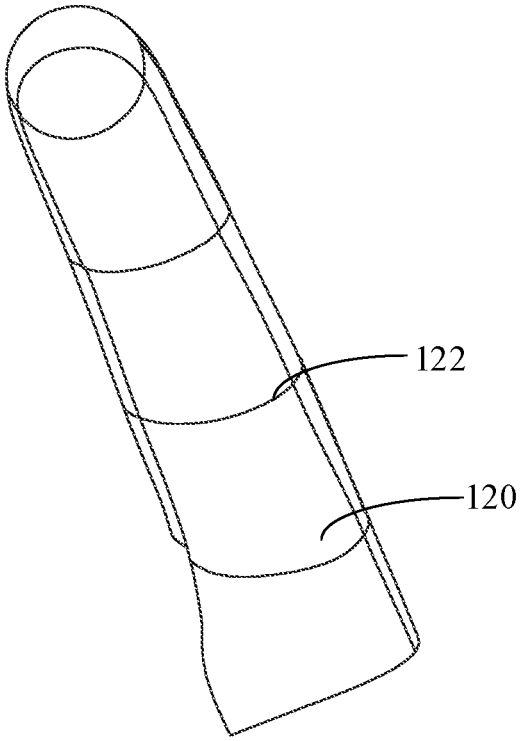
FIG. 4 is a structural schematic diagram of the finger part in FIG. 3.

As shown in FIG. 4, the elastic section 122 is preferably provided at the joint of the finger part 120. Among them, the use of elastic materials in the joint area is beneficial for the deformation of finger part 120 during finger bending, improving the flexibility of finger bending, and also reducing the degree of finger fatigue when wearing gloves for long periods of time.

As shown in FIG. 1, the tightening structure 112 is preferably provided at the wearing opening of the main body part 110. Among them, the tightening structure 112 preferably adopts the form of a tightening belt, which means that one end of the tightening belt is fixed on the main body part 110, and the other end can be fixed on the main body part 110 or the tightening belt itself after winding around the wearing opening for one circle. Refer to Velcro or watch strap, etc. for the specific fixation method. In addition, the tightening belt is preferably made of Microfiber PU synthetic leather. Microfiber PU synthetic leather is a non-woven fabric with three-dimensional structure network made of Microfiber staple fibers through carding and needling, and processed through wet processing, PU resin impregnation, alkali peeling, polishing, dyeing and finishing. The tightening belt made of this material has extremely excellent wear resistance, excellent cold resistance, air permeability, and aging resistance. It should be noted that PU is the abbreviation for polyurethane in English, and the chemical name in Chinese is ""聚氨酯"".

Figure 5:
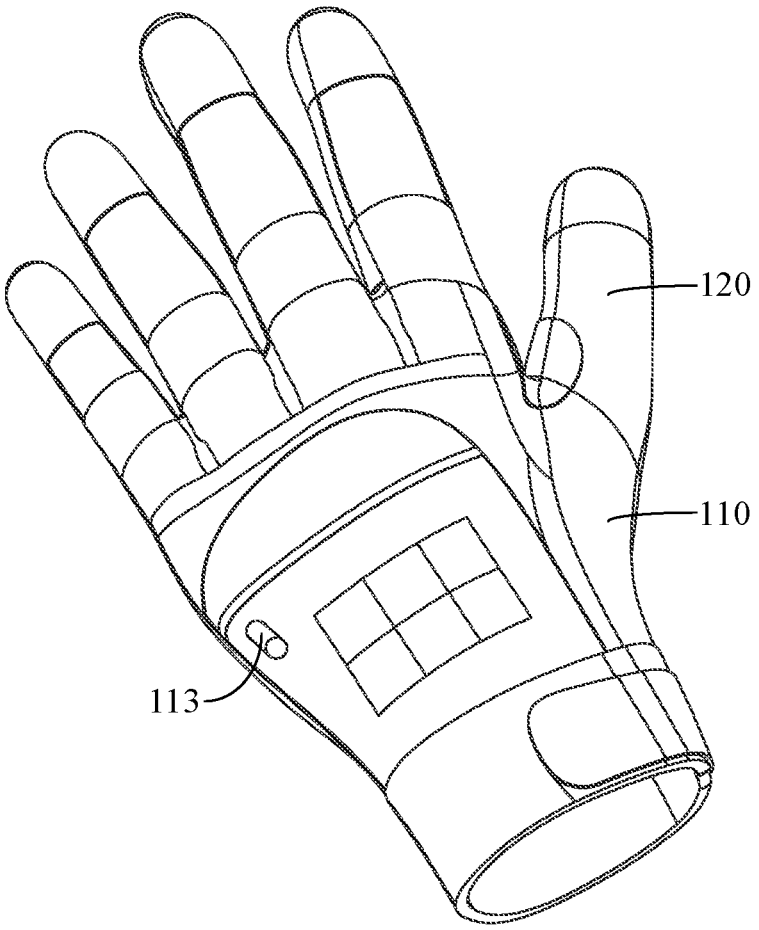
FIG. 5 is a structural schematic diagram of the second embodiment of the magnetic glove in the invention.

As shown in FIG. 5, the storage part 113 is preferably provided on the outer side of the main body part 110. Among them, the storage part 113 can be set according to the actual item to be placed. For example, when a screwdriver needs to be placed, the storage part 113 is an elastic band connected to the main body part 110 at both ends, and the elastic band is enclosed with the main body part 110 to form a storage space for fixing the item. In this embodiment, when inserting the screwdriver into the storage space, the deformation of the elastic band can be used to firmly fix the screwdriver.

Figure 6:
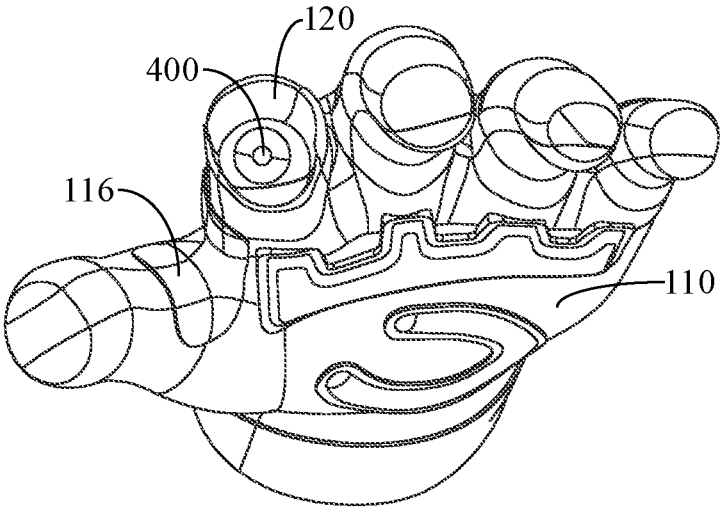
FIG. 6 is a structural schematic diagram of the fill light in the invention.
Figure 7:
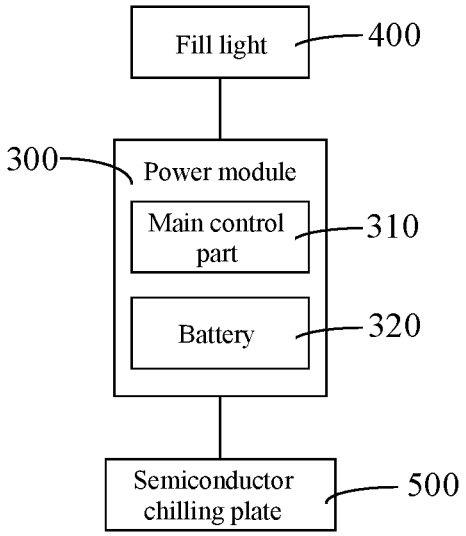
FIG. 7 is a schematic diagram of the modules of the fill light, power module, and semiconductor chilling plate in the invention.

As shown in FIGS. 6 and 7, the finger part 120 includes a luminous finger part 130, which is provided with a fill light 400. In this embodiment, the luminous finger part 130 is preferably the index finger part, and the fill light 400 is located at the fingertip of the index finger part, so that the other four fingers can also use the fill light 400 on the index finger part for lighting when grabbing objects. This does not affect the actual operation and also facilitates the adjustment of the lighting position during work, greatly enhancing the practicality of the glove.

In this embodiment, the main body part 110 is provided with a power module 300, and the fill light 400 is electrically connected to the power module 300. Among them, the fill light 400 is preferably LED light, which is beneficial for increasing illumination and reducing energy consumption. Moreover, the fill light 400 can also be detachably installed on the main body part 110, referring to the fixed form of the existing lighting lamp, connected or clamped with screws, so as to facilitate the replacement of the fill light 400 after it is damaged. In addition, the power module 300 is electrically connected to the fill light 400 through wires, which are preferably embedded in the finger part 120 and the main body part 110 to protect the wires. In this embodiment, power is supplied to the fill light 400 through the power module 300, and the light emitted by the fill light is used for illumination, thereby facilitating work in low light conditions.

As shown in FIG. 7, the main body part 110 is preferably provided with a semiconductor chilling plate 500 electrically connected to the power module 300. Among them, the semiconductor chilling plate 500 does not have sliding components. By utilizing the Peltier effect of semiconductor materials, when direct current passes through two different semiconductor materials connected in series to form a couple, heat can be absorbed and released at both ends of the couple, achieving the purpose of cooling. Specifically, some heat dissipation parts connected to the hot end of the semiconductor chilling plate 500 can be installed on the surface side of the body 100 to reduce the temperature of the hot end of the semiconductor chilling plate 500. In this embodiment, the semiconductor chilling plate 500 can effectively reduce the temperature inside the glove, thereby improving the usability of the glove in high-temperature environments and greatly enhancing the practicality of the glove.

Preferably, multiple semiconductor chilling plates 500 are uniformly arranged on the main body part 110. Among them, in order not to affect the normal use of gloves, the semiconductor chilling plates 500 are arranged in a large and small form. The specific position of the semiconductor chilling plates 500 can be determined according to the actual situation, preferably on the back side of the main body part 110, which is conducive to reducing the impact on the normal function of the glove.

Preferably, the semiconductor chilling plate 500 is embedded inside the main body part 110. Among them, the semiconductor chilling plate 500 can be embedded in the main body part 110 during the sewing process, which is conducive to protecting the semiconductor chilling plate 500 from damage.

Figure 8:
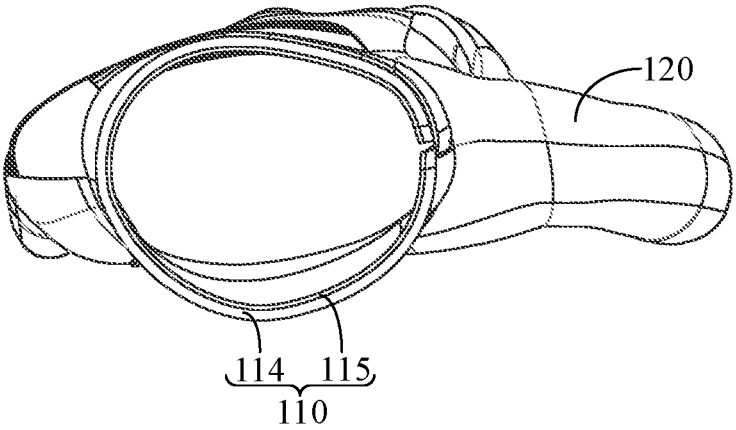
FIG. 8 is a structural schematic diagram of the third embodiment of the magnetic glove in the invention.

As shown in FIG. 8, the main body part 110 preferably includes an outer protective sleeve and an inner liner 115 that can be detachably connected inside the outer protective sleeve. The semiconductor chilling plate 500 is located between the outer protective sleeve and the inner liner 115. Among them, the outer protective sleeve is preferably made of materials with higher strength, which is beneficial for improving protective performance, while the inner liner 115 is preferably made of materials with higher softness, which is beneficial for improving wearing comfort. As for the method of fixing the inner liner 115 on the outer protective sleeve, Velcro can be used. At this point, preferably the hot end of the semiconductor chilling plate 500 is in contact with the heat dissipation part mentioned above, and the semiconductor chilling plate 500 is also electrically connected to the power module 300 through wire insertion, thereby facilitating the disassembly and assembly of the semiconductor. In addition, an embedding position can be set inside the outer protective sleeve, specifically a concave cavity that is suitable for the semiconductor chilling plate 500, thereby facilitating the positioning of the semiconductor chilling plate 500. In this embodiment, the detachable inner liner 115 is fixed inside the outer protective sleeve, which is beneficial for the disassembly and assembly of the semiconductor chilling plate 500. It is not only convenient for the replacement of the semiconductor chilling plate 500 after damage, but also for the recycling of the semiconductor chilling plate 500 after the gloves are scrapped.

Figure 9:
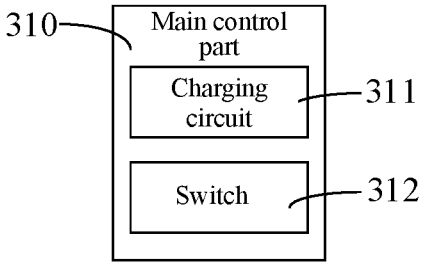
FIG. 9 is a schematic diagram of the power module in the invention.

As shown in FIG. 9, the power module 300 preferably includes a main control part 310 and a battery 320 electrically connected to the main control part 310. The main control part 310 includes a charging circuit 311 electrically connected to the battery 320 and a switch 312 electrically connected to the fill light 400 and the semiconductor chilling plate 500. Among them, the charging circuit 311 can be connected to an external power source through an interface to charge the battery 320. As for the interface, existing universal charging interfaces can be used, such as wired USB interfaces or wireless charging interfaces. The battery 320 preferably uses a lithium battery 320, and at this time, the switch 312 needs to have the function of controlling the start and stop of the above-mentioned fill light 400 and semiconductor chilling plate 500 respectively, that is the battery 320 is electrically connected to the above-mentioned fill light 400 and the semiconductor chilling plate 500 through the switch 312. In addition, a temperature sensor electrically connected to the switch 312 can also be installed inside the main body part 110 to detect the temperature inside the glove. This facilitates the automatic conduction of the semiconductor chilling plate 500 through the switch 312 when the temperature exceeds the preset value, and when the temperature is detected to be lower than the preset value, the semiconductor chilling plate 500 can be turned off through the switch 312, greatly improving the practicality of the glove.

As shown in FIG. 6, a reinforcing layer 116 is arranged on the main body part 110 at the position (the web between the thumb and index finger) between the thumb part and index finger part, preferably made of microfiber leather or anti-slip and wear-resistant materials, which can be sewn on the surface of the main body part 110. In this embodiment, increasing the strength of the glove at the web is beneficial for improving its service life due to the significant friction it receives during use.

At least one of the finger parts 120 is provided with a second magnetic adsorption component. Among them, it is preferred to have a second magnetic adsorption component on the thumb part and index or middle fingers to facilitate the use of magnetic adsorption to adsorb the screw; thereby avoiding the screw from falling off when held in hand. In addition, the second magnetic adsorption component can be set according to the first magnetic adsorption component 200, but the magnetic adsorption surface of the second magnetic adsorption component is much smaller than the magnetic adsorption surface of the first magnetic adsorption component 200. Of course, the second magnetic adsorption component can also be in the form of a flexible magnetic disc 210, thereby reducing the impact on the normal function of the glove.

The inner side of the finger part 120 is provided with an cut resistant layer. Among them, the cut-resistant layer is made of aramid, which is called "poly (terephthaloyl P-Phenylenediamine)" in full. It is a new high-tech synthetic fiber, which has excellent properties such as ultra-high strength, high modulus, high temperature resistance, acid and alkali resistance, light weight, good insulation and anti-aging performance, and has a long life cycle. The cut-resistant layer is made of aramid fiber, which enables the cut-resistant layer to protect users' hands from damage caused by high temperatures, acids, alkalis, and sharp objects.

The preferred material for the inner side of the main body part 110 and finger part 120 is natural leather; The main body part 110 and finger part 120 are both made of polyester or nylon. Among them, natural leather is an animal hide that has been treated through processes such as dehairing and tanning to become resistant to decay and has a special grain layer on the surface, with natural grain patterns and luster. It has a comfortable feel and can be made from pigskin, cowhide, sheepskin, or other animal hides as needed. The inner sides of the main body part 110 and finger part 120 are made of natural leather, making them hygroscopic, soft, wear-resistant, and comfortable. The outer sides of the main body part 110 and finger part 120 can be made of polyester, which is a fiber made of polyethylene terephthalate (PET) after spinning and post-processing. The outer sides of the main body part 110 and finger part 120 are made of polyester, making the main body part 110 and finger part 120 durable, elastic, not easily deformed, corrosion-resistant, and insulated.

The wearing opening of the main body part 110 is made of nylon coated with chloroprene rubber, which makes the wearing opening of the main body part 110 both sturdy and durable, and has functions such as flame retardancy, oil resistance, and acid and alkali resistance, comprehensively ensuring the safety of workers' wrists.

The magnetic disc 210 on the left hand magnetic glove and the magnetic disc 210 on the right hand magnetic glove are placed in opposite directions (i.e. the magnetic poles on the side where the magnetic disc 210 faces outward on both magnetic gloves are opposite), making it easier to use the two magnetic discs 210 to fix the left hand magnetic glove and the right hand magnetic glove together without wearing them, thereby avoiding the loss of the magnetic gloves.

The working method of the magnetic gloves provided in the embodiment of this application can be as follows: after the user sets the magnetic gloves on their right hand, they can use the tightening structure to tighten the wearing opening. At this time, the screws and other components can be placed on the magnetic disc 210, and the screw can be fixed using the adsorption ability of the magnetic disc 210. When the screw needs to be used, the screw can be grabbed with the left hand, and then the screw driver can be grabbed with the right hand to fix the screw. In addition, in low light conditions, the fill light 400 on the index finger can also be turned on through switch 312 to facilitate lighting during screw tightening, avoid errors, and improve work efficiency. In addition, screw holes can also be found in low light conditions to facilitate screw alignment and tightening. Moreover, when working in high temperature environments, wearing magnetic gloves on the right hand will inevitably result in a higher internal temperature of the magnetic gloves. Therefore, the semiconductor chilling plate 500 can also be opened through switch 312 to reduce the temperature inside the magnetic gloves.

Figure 10:
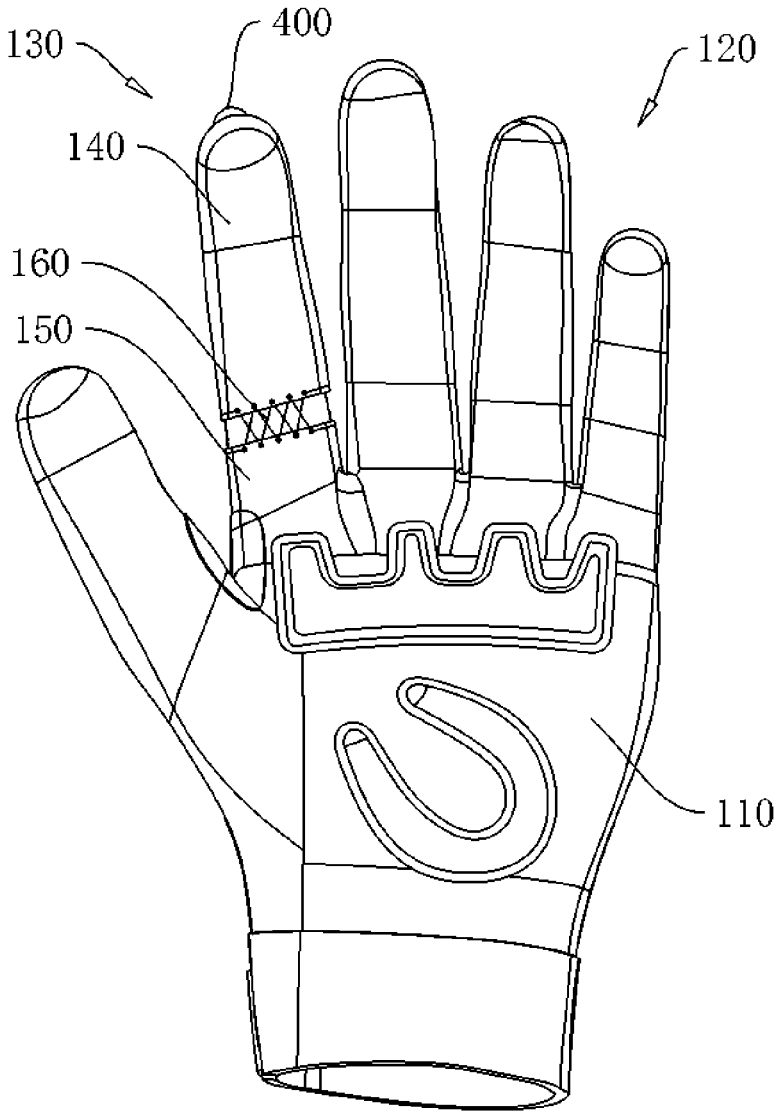
FIG. 10 is a structural schematic diagram of the fourth embodiment of the magnetic glove in the invention.

As shown in FIG. 10, the finger part 120 includes a luminous finger part 130, and a fill light 400 is provided at one end of the luminous finger part 130 away from the main body part 110. The luminous finger part 130 includes a first section 140, a second section 150, and a tension rope 160, wherein the first section 140 is located at one end of the luminous finger part 130 away from the main body part 110, and the fill light 400 is provided at the first section 140. The second section 150 is located at one end of the luminous finger part 130 near the main body part 110, and is connected to the main body. The first section 140 and the second section 150 are spaced to form a spacing distance.

The tension rope 160 is movably connected between the first section 140) and the second section 150, and is used to limit the distance between the first section 140 and the second section 150. By activating the tension rope 160 between the first section 140 and the second section 150, the restriction of the tension rope 160 between the first section 140 and the second section 150 can be changed, thereby adjusting the spacing distance between the first section 140 and the second section 150, changing the overall length of the luminous finger part 130, and adjusting the distance between the fill light 400 and the main body part 110.

It can be understood that since the fill light 400 is located at the end of the luminous finger part 130, after wearing magnetic gloves, users can change the bending angle of the luminous finger part 130 by bending their fingers, so that the fill light 400 emits light at a specified angle, making it convenient for users to illuminate the specified position.

However, in the case where the length of the user's finger is relatively short compared to the overall length of the luminous finger part 130, there may be a gap between the fingertip of the user's finger and the fill light 400 after wearing magnetic gloves, which makes it difficult for the fill light 400 to emit light at the specified angle when the finger is bent, making it difficult for the user to control the light emitting angle of the fill light 400.

The embodiment of this application adjusts the distance between the fill light 400 and the main body part 110, allowing the user to adjust the tension rope 160 according to their own finger length to change the spacing distance between the first section 140 and the second section 150, adjust the overall length of the luminous finger part 130, so that the overall length of the luminous finger part 130 can adapt to the user's finger length. In this way, after the user wears magnetic gloves, the fill light 400 can be located at the fingertips of the fingers, making it convenient for users to control the luminous angle of the fill light 400 and improving the user experience.

Figure 11:
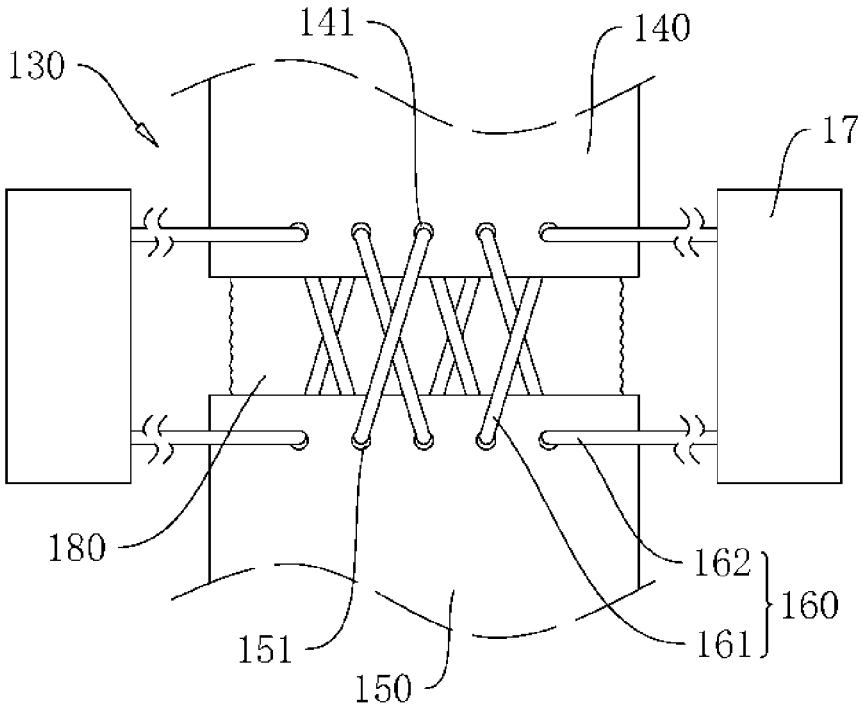
FIG. 11 is a structural schematic diagram of the first section, second section, and tension rope in the invention.

As shown in FIG. 11, further, the first section 140 is provided with multiple first adjustment holes 141, which are arranged at circumferential intervals along the first section 140. The first adjustment holes 141 run through the first section 140. The second section 150 is equipped with multiple second adjustment holes 151, which are arranged at intervals along the circumference of the second section 150. The second adjustment holes 151 run through the second section 150. The number of multiple first adjustment holes 141 and multiple second adjustment holes 151 is the same, and the multiple first adjustment holes 141 correspond to the multiple second adjustment holes 151 one by one. The distance between each first adjustment hole 141 and adjacent second adjustment holes 151 is equal.

The tension rope 160 is staggered through multiple first adjustment holes 141 and multiple second adjustment holes 151, thereby limiting the distance between each first adjustment hole 141 and adjacent second adjustment holes 151. By moving the tension rope 160 between multiple first adjustment holes 141 and multiple second adjustment holes 151, the tension rope 160 can be relaxed or tightened.

It can be understood that the distance between the first section 140 and the second section 150 determines the distance between the first adjustment hole 141 and the adjacent second adjustment hole 151. By relaxing the tension rope 160, the distance between the first adjustment hole 141 and the second adjustment hole 151 can be increased, thereby increasing the spacing distance and extending the overall length of the luminous finger part 130, making it suitable for users with longer fingers. On the contrary; by tightening the tension rope 160, the distance between the first adjustment hole 141 and the second adjustment hole 151 can be reduced, thereby reducing the spacing distance and shortening the overall length of the luminous finger part 130, making it suitable for users with shorter fingers.

Figure 12:
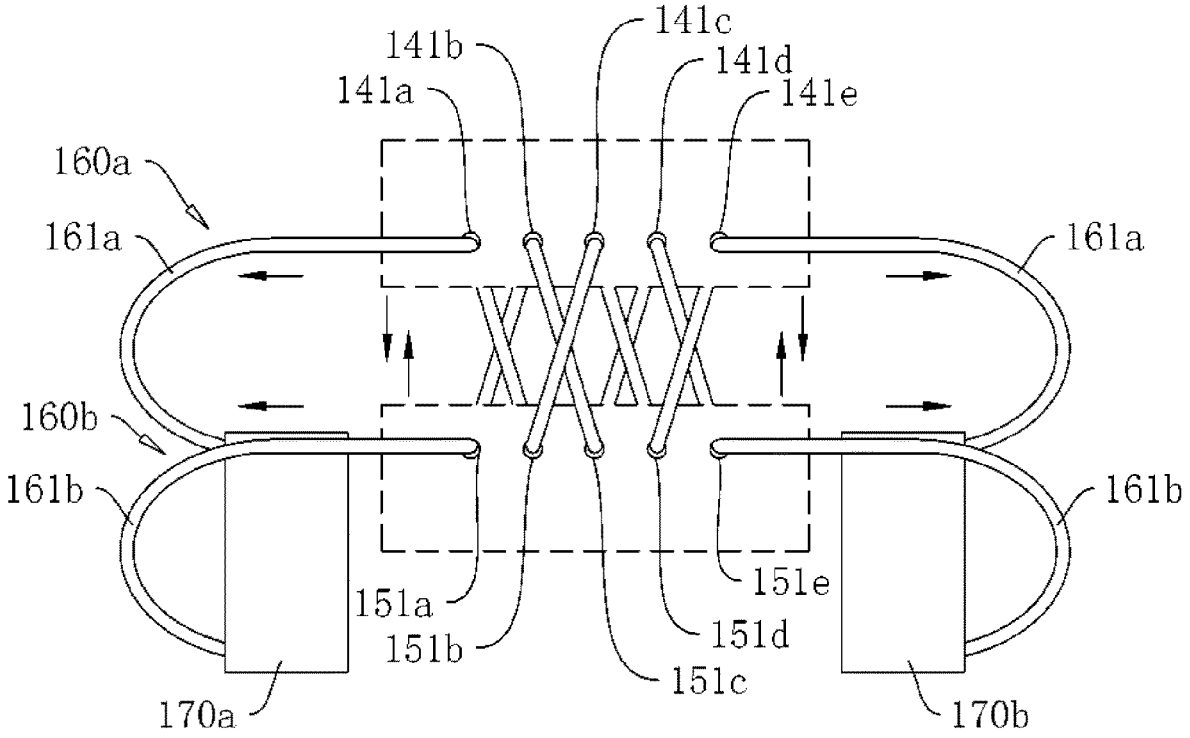
FIG. 12 is a schematic diagram of the principle of tightening the tension rope in the invention.

As shown in FIGS. 11 and 12, in one example of this embodiment, the number of tension ropes 160 is 2, the number of first adjustment holes 141 is 5, and the number of second adjustment holes 151 is 5. The tension rope 160 includes tension rope 160*a* and tension rope 160*b*. The first adjustment hole 141 includes a first adjustment hole 141*a*, a first adjustment hole 141*b*, a first adjustment hole 141*c*, a first adjustment hole 141*d*, and a first adjustment hole 141*e*. The second adjustment hole 151 includes a second adjustment hole 151*a*, a second adjustment hole 151*b*, a second adjustment hole 151*c*, a second adjustment hole 151*d*, and a second adjustment hole 151*e*.

Among them, the tension rope 160*a* is sequentially threaded through the first adjustment hole 141*a*, the second adjustment hole 151*b*, the first adjustment hole 141*c*, the second adjustment hole 151*d*, and the first adjustment hole 141*e*.

The tension rope 160*b* is sequentially threaded through the second adjustment hole 151*a*, the first adjustment hole 141*b*, the second adjustment hole 151*c*, the first adjustment hole 141*d*, and the second adjustment hole 151*e*.

When the tension rope 160*a* and tension rope 160*b* are relaxed, the rope length between the first adjustment hole 141*a*, the second adjustment hole 151*b*, the first adjustment hole 141*c*, the second adjustment hole 151*d*, and the first adjustment hole 141*e* can be increased, and the rope length between the second adjustment hole 151*a*, the first adjustment hole 141*b*, the second adjustment hole 151*c*, the first adjustment hole 141*d*, and the second adjustment hole 151*e* can be increased, thereby increasing the spacing distance.

On the contrary; when the tension rope 160*a* and tension rope 160*b* are tightened, the rope length between the first adjustment hole 141*a*, the second adjustment hole 151*b*, the first adjustment hole 141*c*, the second adjustment hole 151*d*, and the first adjustment hole 141*e* can be reduced, while reducing the rope length between the second adjustment hole 151*a*, the first adjustment hole 141*b*, the second adjustment hole 151*c*, the first adjustment hole 141*d*, and the second adjustment hole 151*e*, thereby reducing the spacing distance.

In this embodiment, the luminous finger part 130 further includes a fixing member 170, which is fixedly connected to the tension rope 160, and the fixing member 170 is detachably connected to the luminous finger part 130. When the tension rope 160 needs to be relaxed or tightened, the fixing member 170) can be fixed from the luminous finger part 130. After the tension rope 160 is relaxed or tightened, the fixing member 170 can be re-fixed to the luminous finger part 130 to maintain the adjusted spacing distance of the tension rope 160.

Specifically, the tension rope 160 includes a stretch section 161 and a fixing section 162, which is located between the first adjusting hole 141 and the second adjusting hole 151. One end of the fixing section 162 is connected to the stretch section 161, and the other end of the fixing section 162 is connected to the fixing member 170. Among them, the two ends of the tension rope 160 are fixing sections 162, and the middle of the tension rope 160 is a stretch section 161.

In the above example of this embodiment, the part of the tension rope 160*a* between the first adjustment hole 141*a*, the second adjustment hole 151*b*, the first adjustment hole 141*c*, the second adjustment hole 151*d*, and the first adjustment hole 141*e* is a stretch section 161, and the two ends of the tension rope 160*a* (i.e., one end penetrating the first adjustment hole 141*a* and one end penetrating the first adjustment hole 141*e*) are fixed sections 162*a*. Similarly, the part of the tension rope 160*b* between the second adjustment hole 151*a*, the first adjustment hole 141*b*, the second adjustment hole 151*c*, the first adjustment hole 141*d*, and the second adjustment hole 151*e* is the stretch section 161, and the two ends of the tension rope 160*b* (i.e., one end penetrating the second adjustment hole 151*a* and one end penetrating the second adjustment hole 151*e*) are the fixing sections 162*b*.

In the above example, the number of fixing members 170 is 2, and the fixing parts 170 include fixing members 170*a* and 170*b*. Among them, the tension rope 160*a* passes through the fixing section 162*a* of the first adjustment hole 141*a* and is fixedly connected to the fixing member 170*a*, while the tension rope 160*b* passes through the fixing section 162*b* of the second adjustment hole 151*a* and is also fixedly connected to the fixing member 170*a*. The tension rope 160*a* passes through the fixing section 162*a* of the first adjustment hole 141*e* and is fixedly connected to the fixing member 170*b*, while the tension rope 160*b* passes through the fixing section 162*b* of the second adjustment hole 151*e* and is also fixedly connected to the fixing member 170*b*.

In this embodiment, the fixing member 170 not only serves to fix the fixing section 162, but also plays a role in driving tension and contraction.

When tightening tension rope 160*a* and tension rope 160*b*, the fixing member 170 can be removed from the luminous finger part 130, and then the fixing member 170*a* and fixing member 170*b* can be pulled to move the fixing part 170*a* and fixing member 170*b* away from the stretch section 161, respectively, thereby lengthening the fixing section 162 of tension rope 160*a* and tension rope 160*b*, shortening the stretch section 161 of tension rope 160*a* and tension rope 160*b*, and reducing the spacing distance, then, fix the fixing member 170 again to the luminous finger part 130 to maintain this spacing distance.

When tightening tension ropes 160*a* and 160*b*, the fixing member 170 can be removed from the luminous finger part 130, and then the first section 140 can be pulled to move away from the second section 150, thereby extending the stretch section 161 of tension ropes 160*a* and 160*b*, shortening the fixing section 162 of tension ropes 160*a* and 160*b*, increasing the spacing distance, and then re fixing the fixing member 170 to the luminous finger part 130 to maintain this spacing distance.

Figure 13:
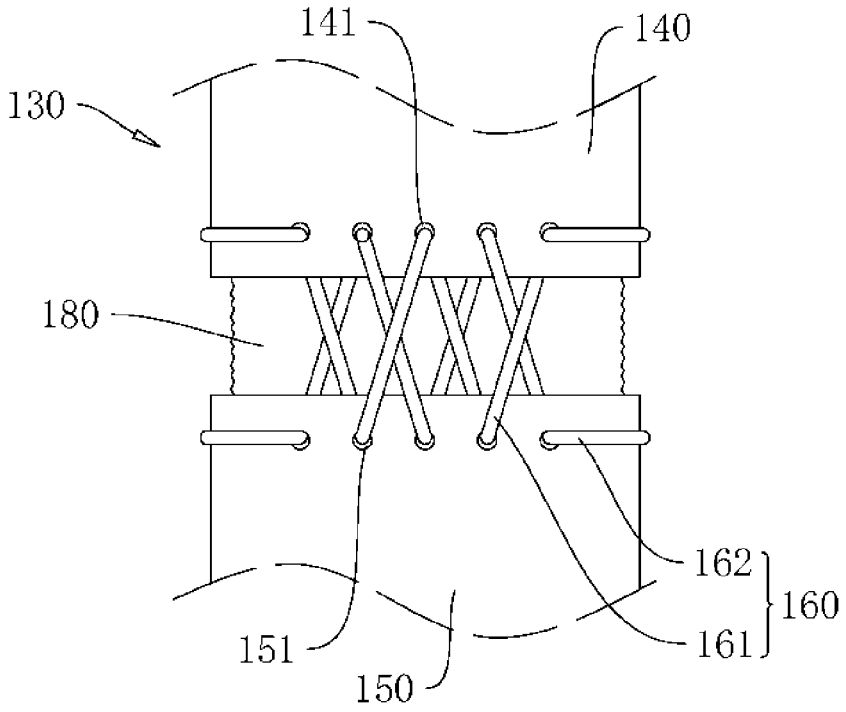
FIG. 13 is a structural schematic diagram of the luminous finger part facing the front of the finger in the invention.
Figure 14:
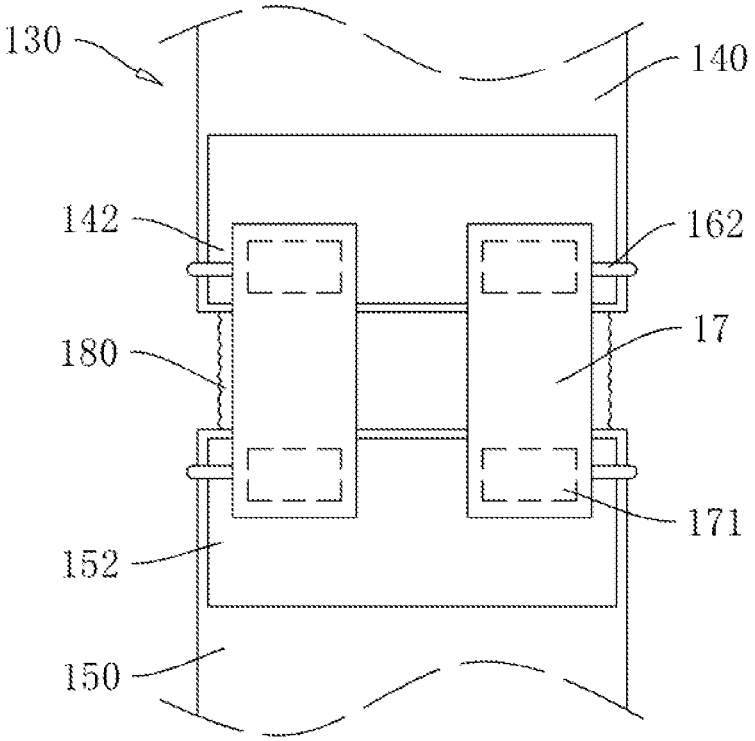
FIG. 14 is a structural schematic diagram of the luminous finger part facing the back of the finger in the invention.

As shown in FIGS. 13 and 14, in one embodiment of this invention, a tension string 160 is provided on one side of the luminous finger part 130 close to the front of the finger (i.e. the side of the finger with the fingerprint), and a fixing member 170 is connected on one side of the luminous finger part 130 close to the back of the finger (i.e. the side of the finger with the nail).

The first adjustment hole 141 is located on the side near the front of the finger in the first section 140, and the second adjustment hole 151 is located on the side near the front of the finger in the second section 150. The fixing member 170 is detachably connected to the side of the first section 140 near the back of the finger, and detachably connected to the side of the second section 150 near the back of the finger.

The stretch section 161 of the tension rope 160 is arranged on the side of the luminous finger part 130 close to the front of the finger, and the fixing section 162 of the tension rope 160 is connected to the fixing member 170 by bypassing the luminous finger 130 close to the back of the finger.

Specifically, the detachable connection between the fixing member 170 and the luminous finger part 130 is achieved through a Velcro. The fixing member 170 is provided with a third Velcro, the first section 140 is provided with a fourth Velcro on the side close to the back of the finger, and the second section 150 is provided with a fifth Velcro on the side close to the back of the finger, allowing the fixing member 170 to be fixed to both the first section 140) and the second section 150 simultaneously. Moreover, both the size of the fourth and fifth Velcro are larger than the size of the third Velcro, so that when the distance between the first section 140 and the second section 150 changes, the fixing member 170) can still be fixed to the first section 140) and the second section 150 through the third Velcro.

It can be understood that the side of the first section 140 close to the front of the finger and the side of the second section 150 close to the front of the finger are limited by a tension rope 160, while the side of the first section 140 far from the front of the finger and the side of the second section 150 far from the front of the finger are fixed to the fixing member 170. Therefore, the spacing distance can be limited by the fixing member 170, and the fixing member 170 and the tension rope 160 can be limited on both sides of the luminous finger part 130 to improve the installation stability.

On the other hand, the tension rope 160 is arranged on the side near the front of the luminous finger part 130, which is beneficial for the bending deformation of the luminous finger part 130 when the finger is bent. At the same time, the fixing member 170 is fixed on the side of the luminous finger part 130 close to the back of the finger, which can reduce the obstruction of the fixing structure of the fixing member 170 to the bending of the finger and improve wearing comfort.

As shown in FIGS. 11 and 13, in one embodiment of this invention, the luminous finger part 130 further includes a flexible tape 180, which is elastic and circular. The two ends of the flexible tape 180 are connected to the first section 140 and the second section 150, respectively. The internal space of the flexible tape 180 is connected to the internal space between the first section 140 and the second section 150.

Specifically, the outer diameter of the flexible tape 180 is smaller than the inner diameter of the first section 140. One end of the flexible tape 180 is connected to the inner side of the first section 140, and there is an overlap and gap between the end of the first section 140 close to the flexible tape 180 and the flexible tape 180. The first adjustment hole 141 is set at the end of the first section 140 close to the flexible tape 180, and the tension rope 160 can be accommodated within this gap.

The outer diameter of the flexible tape 180 is smaller than the inner diameter of the second section 150. The end of the flexible tape 180 that is far away from the first section 140 is connected to the inner side of the second section. There is an overlap and a gap between the end of the second section 150 that is close to the flexible tape 180 and the flexible tape 180. The second adjustment hole 151 is set at the end of the second section 150 that is close to the flexible tape 180, and the tension rope 160 can be accommodated within this gap.

When the tension rope 160 is tightened, the distance between the first section 140 and the second section 150 decreases, and the flexible tape 180 folds. When the tension rope 160 is relaxed, the distance between the first section 140) and the second section 150 increases, and the flexible tape 180 relaxes. On the one hand, the flexible tape 180 can block the space between the first section 140 and the second section 150, and on the other hand, it can connect the first section 140 and the second section 150 to prevent the second section 150 from completely separating from the first section 140.

The above are only partial or preferred embodiments of the invention, and neither the text nor the figures shall limit the scope of protection of the invention. Any equivalent structural changes made using the description and figures of the invention, or direct/indirect application in other related technical fields, under the overall concept of the invention, are included in the scope of protection of the invention.

What is claimed is:

1. A magnetic glove comprising a body and a first magnetic adsorption component, wherein the body comprises a main body part and multiple finger parts connected to the main body, and the first magnetic adsorption component is arranged on a back side of the main body part;

at least one of the multiple finger part includes a luminous finger part, and an end of the luminous finger part away from the main body part is provided with a fill light;

the luminous finger part comprises a first section, a second section, and a tension rope;

the second section is connected to the main body part, and the tension rope is movably connected between the first section and the second section;

the first section and the second section are spaced to form a spacing distance, and the tension rope is used to limit the spacing distance;

the first section is provided with multiple first adjustment holes arranged at intervals, the second section is provided with multiple second adjustment holes arranged at intervals, and the tension rope is staggered through multiple first adjustment holes and multiple second adjustment holes;

the luminous finger part also includes a fixing member for detachably fixing the tension rope to the first section and the second section, the fixing member is connected to the tension rope and detachably connected to the luminous finger part;

the tension rope comprises a stretch section and a fixing section, wherein the stretch section is located between the multiple first adjustment holes and the multiple second adjustment holes, one end of the fixing section is connected to the stretch section, and an other end of the fixing section is connected to the fixing member.

2. The magnetic glove of claim 1, wherein:

the first magnetic adsorption component comprises a fixed part and a magnetic disc arranged on the fixed part, and the fixed part is detachably connected to the main body part.

3. The magnetic glove of claim 2, wherein:

a first hook-and-loop component is provided on the main body part, a second hook-and-loop component is provided on the fixing part, and the first hook-and-loop component is bonded to the second hook-and-loop component.

4. The magnetic glove of claim 1, wherein:

a wearing opening of the main body part is provided with a tightening structure;

the tightening structure comprises a tightening belt, one end of the tightening belt is fixed on one area of the main body part, and an other end of the tightening belt is configured to detachably fix on another area of the main body part.

5. The magnetic glove of claim 1, wherein:

the first section is provided with the fill light.

6. The magnetic glove of claim 5, wherein:

the multiple first adjustment holes are arranged on a side adapted to be near the front of the finger in the first section, and the multiple second adjustment holes are arranged on a side adapted to be near the front of the finger in the second section;

the fixing member is detachably connected to a side of the first section, and detachably connected to a side of the second section.

7. The magnetic glove of claim 5, wherein:

the luminous finger part further comprises a flexible tape, wherein an end of the flexible tape is connected to an inner side of the first section, and another end of the flexible tape is connected to an inner side of the second section, and an end of the first section is provided with a first adjustment hole, and an end of the second section is provided with a second adjustment hole.

8. The magnetic glove of claim 1, wherein:

the fixing member comprises a third hook-and-loop component;

the first section comprises a fourth hook-and-loop component;

the second section comprises a fifth hook-and-loop component;

the third hook-and-loop component is configured to be attached to the fourth hook-and-loop component and the fifth hook-and-loop component for securing the tension rope to the first section.

* * * * *